US007958936B2

(12) United States Patent
McGregor et al.

(10) Patent No.: US 7,958,936 B2
(45) Date of Patent: Jun. 14, 2011

(54) DOWNHOLE FORMATION SAMPLING

(75) Inventors: Malcolm Douglas McGregor, Spring, TX (US); John C. Welch, Spring, TX (US); Michael T. Pelletier, Houston, TX (US); Anthony Herman van Zuilekom, Houston, TX (US); Thomas F. Ballweg, Jr., Pearland, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 659 days.

(21) Appl. No.: 11/073,089

(22) Filed: Mar. 4, 2005

(65) Prior Publication Data

US 2005/0194134 A1 Sep. 8, 2005

Related U.S. Application Data

(60) Provisional application No. 60/550,245, filed on Mar. 4, 2004.

(51) Int. Cl.
*E21B 49/10* (2006.01)

(52) U.S. Cl. ..... 166/264; 166/100; 175/58

(58) Field of Classification Search ..... 166/264, 166/100, 66, 77, 78, 244; 175/58, 59, 77, 175/78, 244; 73/152.23, 152.24
See application file for complete search history.

(56) References Cited

U.S. PATENT DOCUMENTS

| | | | | |
|---|---|---|---|---|
| 2,391,869 A | | 1/1946 | Bandy | 255/1.4 |
| 2,392,683 A | | 1/1946 | McWhorter | 255/1.4 |
| 2,511,508 A | | 6/1950 | McClinton | 255/1.4 |
| 2,595,018 A | | 4/1952 | Stokesbary | 255/1.4 |
| 2,852,230 A | | 9/1958 | Garrison | 255/1.4 |
| 2,959,397 A | | 11/1960 | Gardner et al. | 255/1.4 |
| 3,085,636 A | * | 4/1963 | Bennett et al. | 175/77 |
| 3,085,637 A | | 4/1963 | Bennett | 175/77 |
| 3,150,727 A | | 9/1964 | Garrison | 175/78 |
| 3,187,824 A | | 6/1965 | Gauban | 175/78 |
| 3,227,228 A | | 1/1966 | Bannister | 175/4 |
| 3,294,170 A | * | 12/1966 | Warren et al. | 166/100 |
| 3,353,612 A | | 11/1967 | Bannister | 175/6 |
| 3,430,716 A | | 3/1969 | Urbanosky | 175/78 |
| 4,280,568 A | | 7/1981 | McPhee et al. | 175/4 |
| 4,280,569 A | | 7/1981 | Mount, II | 175/26 |
| 4,354,558 A | | 10/1982 | Jageler et al. | 175/45 |
| 4,449,593 A | | 5/1984 | Jageler et al. | 175/58 |
| 4,461,360 A | | 7/1984 | Mount, II | 175/78 |
| 4,466,495 A | | 8/1984 | Jageler | 175/59 |
| 4,609,056 A | | 9/1986 | Colle, Jr. et al. | 175/4 |
| 4,629,011 A | | 12/1986 | Reinhardt | 175/58 |
| 4,714,119 A | | 12/1987 | Hebert et al. | 175/20 |
| 4,745,802 A | | 5/1988 | Purfurst | 73/155 |

(Continued)

OTHER PUBLICATIONS

PCT International Search Report; PCT/US05/07104, Mailed Sep. 12, 2005, Mar. 4, 2005.

(Continued)

*Primary Examiner* — Kenneth Thompson
(74) *Attorney, Agent, or Firm* — Baker Botts L.L.P.

(57) ABSTRACT

Methods, systems, and apparatuses for downhole sampling are presented. The sampling system includes a control unit and a housing to engage a conduit. The housing at least partially encloses at least one formation sampler to collect a formation sample. The formation sampler is stored in a sampler carousel. A sampler propulsion system forces the formation sampler into the formation. The propulsion system is in communication with the control unit.

29 Claims, 18 Drawing Sheets

U.S. PATENT DOCUMENTS

| | | | | |
|---|---|---|---|---|
| 4,950,844 | A | 8/1990 | Hallmark et al. | 175/59 |
| 4,979,576 | A | 12/1990 | Barker et al. | 175/4 |
| 5,310,013 | A | 5/1994 | Kishino et al. | 175/44 |
| 5,411,106 | A | 5/1995 | Maissa et al. | 175/78 |
| 5,439,065 | A | 8/1995 | Georgi | 175/59 |
| 5,445,228 | A | 8/1995 | Rathmell et al. | 175/4 |
| 5,487,433 | A | 1/1996 | Mackay et al. | 175/78 |
| 6,388,251 | B1 * | 5/2002 | Papanyan | 250/269.1 |
| 6,412,575 | B1 | 7/2002 | Harrigan et al. | 175/20 |
| 6,557,632 | B2 | 5/2003 | Cernosek | 166/264 |
| 6,568,487 | B2 * | 5/2003 | Meister et al. | 175/50 |
| 6,581,455 | B1 | 6/2003 | Berger et al. | 73/152.55 |
| 6,670,605 | B1 * | 12/2003 | Storm et al. | 250/255 |
| 7,293,715 | B2 * | 11/2007 | Bargach et al. | 235/492 |
| 2002/0148643 | A1 | 10/2002 | Contreras et al. | 175/20 |
| 2004/0099443 | A1 * | 5/2004 | Meister et al. | 175/58 |
| 2004/0173351 | A1 | 9/2004 | Fox et al. | 166/264 |

OTHER PUBLICATIONS

Official Action for Canadian Patent Application No. 2,558,238, dated Sep. 8, 2008.

Official Action issued in Canadian Patent Application 2558238 issued Jan. 4, 2010, 3 pages.

* cited by examiner

DOWNHOLE FORMATION SAMPLING

CROSS-REFERENCE TO RELATED APPLICATION

This application claims priority to commonly owned U.S. provisional patent application Ser. No. 60/550,245, filed Mar. 4, 2004, entitled "MWD Coring," by Malcolm Douglas McGregor.

BACKGROUND

As oil well drilling becomes increasingly complex, the importance of collecting formation samples while drilling increases.

DETAILED DESCRIPTION

Figure 1:
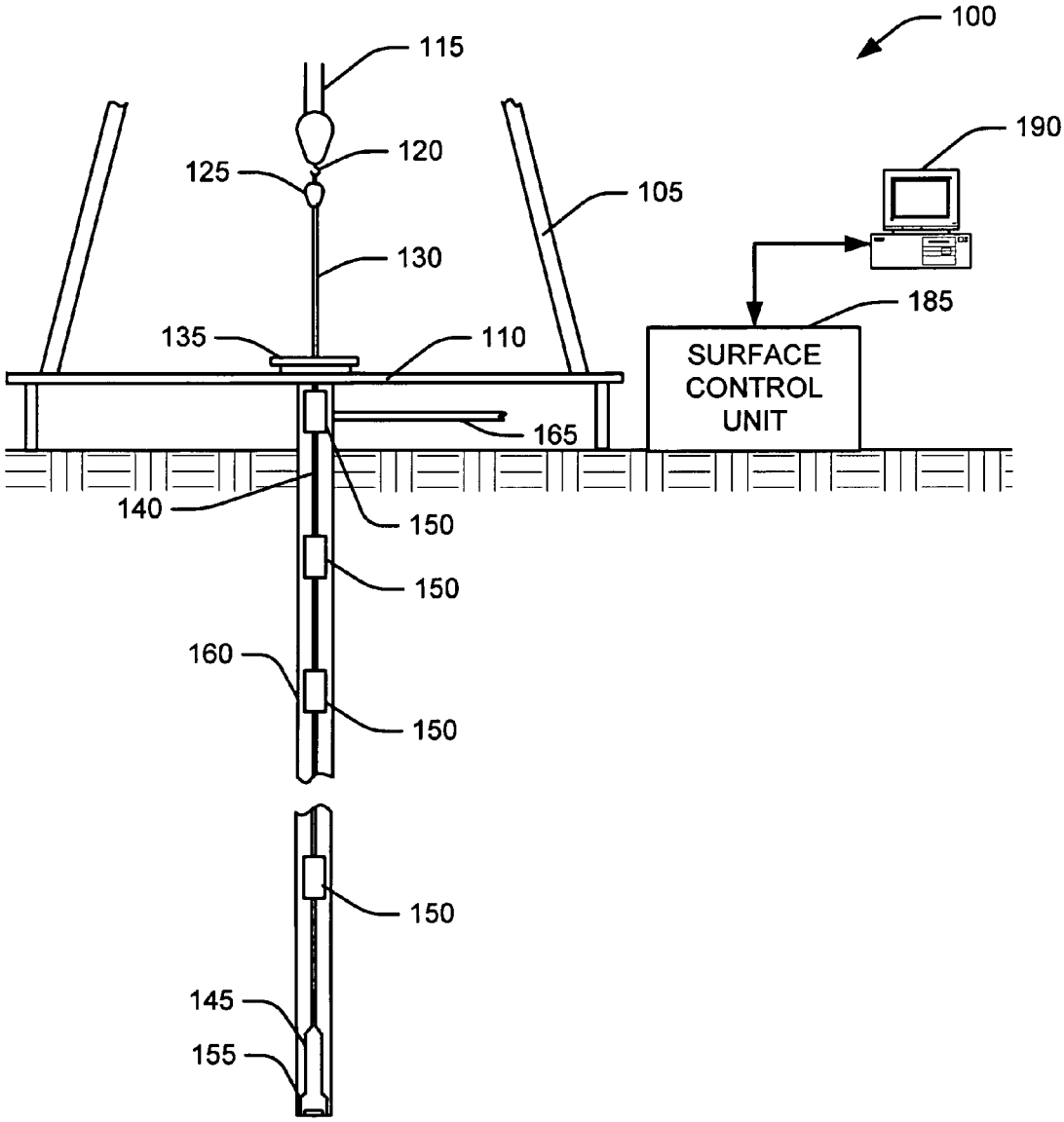
FIG. 1 shows a formation sampling system.

As shown in FIG. 1, oil well equipment 100 (simplified for ease of understanding) includes a derrick 105, derrick floor 110, draw works 115 (schematically represented by the drilling line and the traveling block), hook 120, swivel 125, kelly joint 130, rotary table 135, conduit 140, drill collar 145, LWD tool or tools 200, and drill bit 155. A fluid such as air, mud, or foam is pumped, injected, or circulated into the swivel by a mud supply line (not shown). The fluid is referred to as "mud" within this application for simplicity. The mud travels through the kelly joint 130, conduit 140, drill collars 145, and subs 150 mounted, and exits through jets or nozzles in the drill bit 155. The mud then flows up the annulus between the conduit and the wall of the borehole 160. A mud return line 165 returns mud from the borehole 160 and circulates it to a mud pit (not shown) and back to the mud supply line (not shown). The combination of the drill collar 145, subs 150, and drill bit 155 is known as the bottomhole assembly (or "BHA").

Measurement-While-Drilling (MWD) and Logging-While-Drilling (LWD) (MWD/LWD) tool(s) may be enclosed in portions of the drillstring. For example, the MWD/LWD tools may in one or more of the subs 150, the drill collar 145, or at or about the drill bit 155.

It will be understood that the term "oil well drilling equipment" or "oil well drilling system" is not intended to limit the use of the equipment and processes described with those terms to drilling an oil well. The terms also encompass drilling natural gas wells or hydrocarbon wells in general. Further, such wells can be used for production, monitoring, or injection in relation to the recovery of hydrocarbons or other materials from the subsurface.

The terms "couple" or "couples," as used herein are intended to mean either an indirect or direct connection. Thus, if a first device couples to a second device, that connection may be through a direct connection, or through an indirect electrical connection via other devices and connections.

In one example system, the conduit 140 may include a drillstring including one or more joints of drillpipe or composite pipe. In another example system, the conduit 140 may include coiled tubing. In another example system, the conduit 140 may include a workover string including composite pipe, coiled tubing, or drillpipe. In another example system, the conduit 140 may include a wireline.

Figure 2:
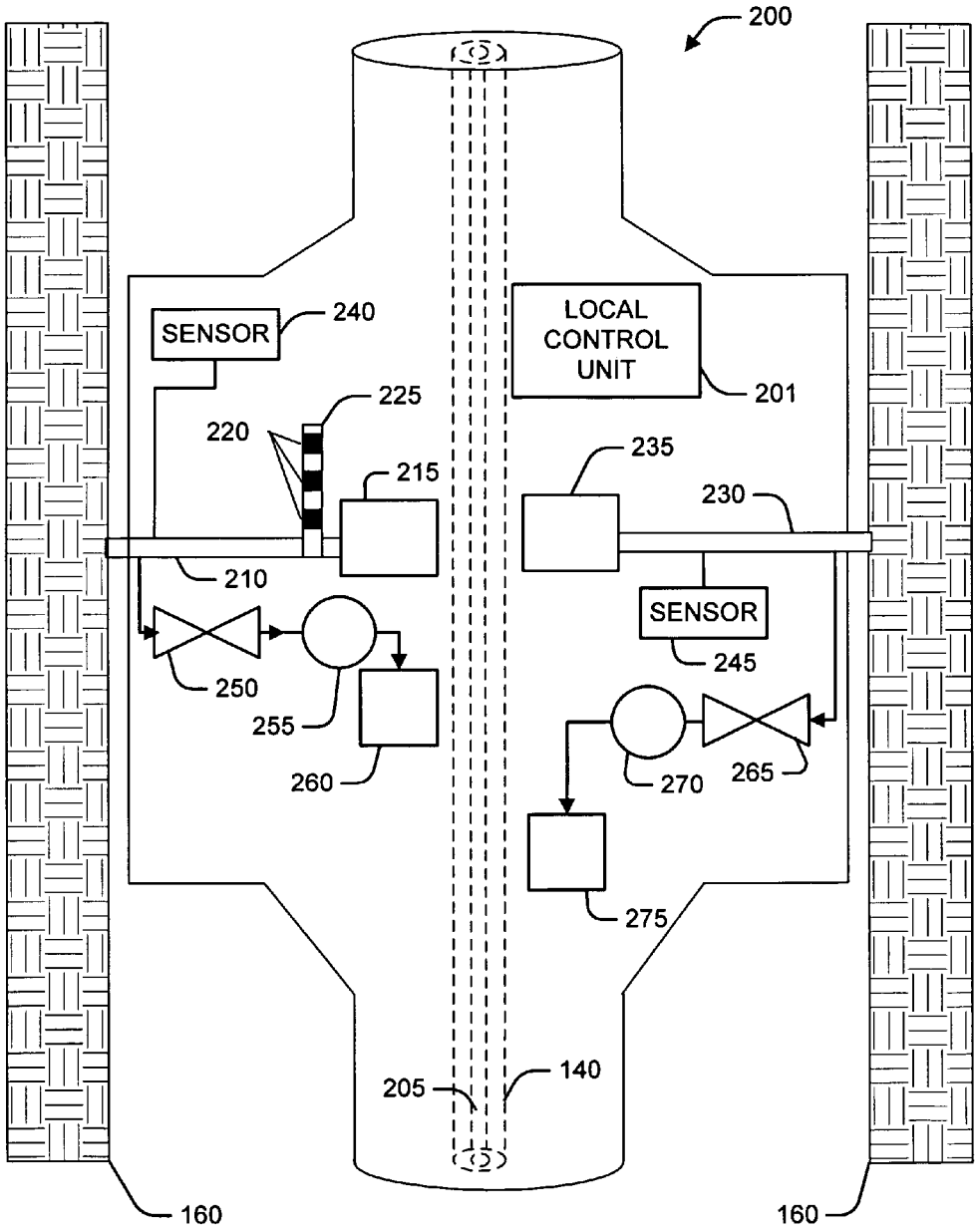
FIG. 2 shows a block diagram of a sampling system.

An example MWD/LWD tool 200, including core-sampling capabilities, is shown in FIG. 2. The MWD/LWD tool 200 includes a local control unit 200 to direct the activities of the modules within the MWD/LWD tool 200. The local control unit 200 may co-ordinate with the surface control unit 185, shown in FIG. 1. The housing of the MWD/LWD tool 200 is positioned on the conduit 140, which has an inner annulus 205. The housing of the MWD tool may be a sub that is formed from drilipipe casing. The MWD/LWD tool 200 may be affixed to the conduit 140 by a conventional means, including screwing the MWD/LWD tool 200 to the conduit 140.

Returning to FIG. 1, in an example system, a communications medium may be located within the conduit, for example, within an inner annulus of conduit 140 or in a gun-drilled channel in conduit 140. The communications medium may permit communications between the surface control unit 185 and one or more downhole components including MWD/LWD tools 200. Communications between the MWD/LWD tools 200 and the surface control unit 185 may be performed using any suitable technique, including electromagnetic (EM) signaling, mud-pulse telemetry, switched packet networking, or connection-based electronic signaling.

The communications medium may be a wire, a cable, a waveguide, a fiber, a fluid such as mud, or any other medium. The communications medium may include one or more communications paths. For example, one communications path may couple one or more of the MWD/LWD tools 200 to the surface control unit 185, while another communications path may couple another one or more MWD/LWD tools 200 to the surface control unit 185.

The communication medium may be used to control one or more elements, such as MWD/LWD tools 200. For example, the surface control unit 185 may direct the activities of the MWD/LWD tools 200, for example by signaling the local control units in one or more MWD/LWD tools 200 to execute a pre-programmed function. The communications medium may also be used to convey data, including sensor measurements. For example, measurements from sensors in MWD/LWD tools 200 may be sent to the surface control unit 185 for further processing or analysis or storage.

The surface control unit 185 may be coupled to a terminal 190, which may have capabilities ranging from those of a dumb terminal to those of a server-class computer. The terminal 190 allows a user to interact with the surface control unit 185. The terminal 205 may be local to the surface control unit 185 or it may be remotely located and in communication with the surface control unit 185 via telephone, a cellular network, a satellite, the Internet, another network, or any combination of these. The communications medium 205 may permit communications at a speed sufficient to allow the surface control unit 185 to perform real-time collection and analysis of data from sensors located downhole or elsewhere Using two or more MWD/LWD tools 200, sensing and testing, including core sampling, may be performed at different depths within the borehole 160 without repositioning the MWD/LWD tools 200.

The MWD/LWD tool 200 shown in FIG. 2 includes a core-sampling system. The MWD/LWD tool 200 includes a sampling arm 210 that may be driven from the MWD/LWD tool 200 into the wall of the borehole 160. The sampling arm 210 may seal the interface between itself and the borehole wall 160. The sampling system includes one or more formation samplers 220, stored in a formation sampler carousel 225. In certain implementations, the formation samplers 220 may be referred to as core cutters. The formation sampler carousel 225 may store the formation samplers 220 before and after they take formation samples. The core-cutter carousel 225 may be moved (e.g., rotated or advanced) so that an unused formation sampler 220 is available for sampling the formation.

The MWD/LWD tool 200 may also include one or more stabilizers, such as stabilizer 230. In general the stabilizer 230 may be arranged in any configuration to engage the borehole wall and provide increased stability to the MWD/LWD tool 200 while it is sampling. In some example implementations, the stabilizer 230 may include a blade or a screw. The stabilizer 230 may be forced out of the MWD/LWD tool 200 and into engagement with the borehole wall 160 by a propulsion device such as propulsion device 235.

Figure 3:
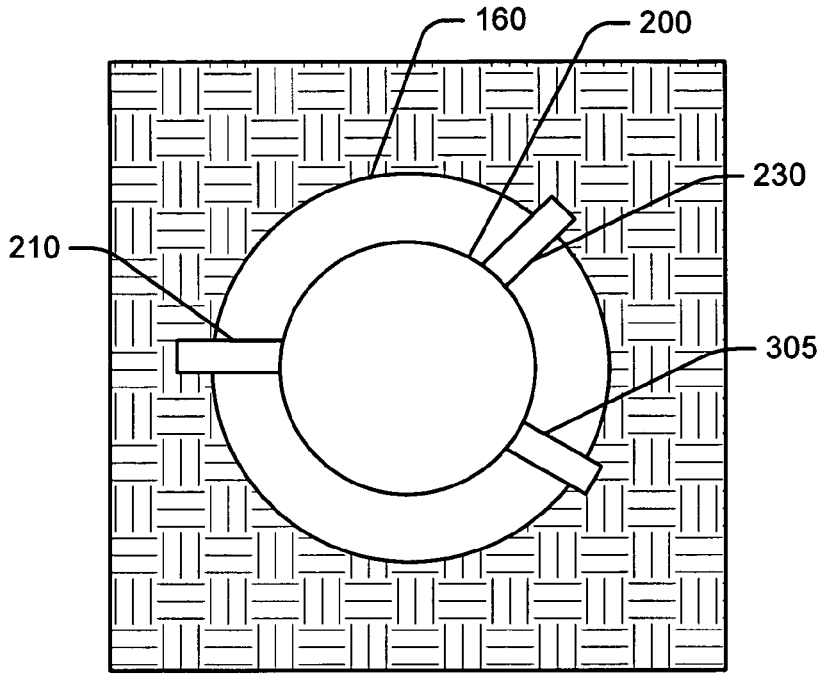
FIG. 3 shows an overhead view of a stabilized sampling system.

An overhead view of an MWD/LWD tool 200 in borehole 160 is shown in FIG. 3. The MWD/LWD tool 200 has an extendable sampling arm 210 and extendable stabilizers 230 and 305. The sampling arm 210 and one or more stabilizers, such as 230 and 305, may be disposed at an angle to each other, to increase the stability of the MWD/LWD tool 200.

Figure 4:
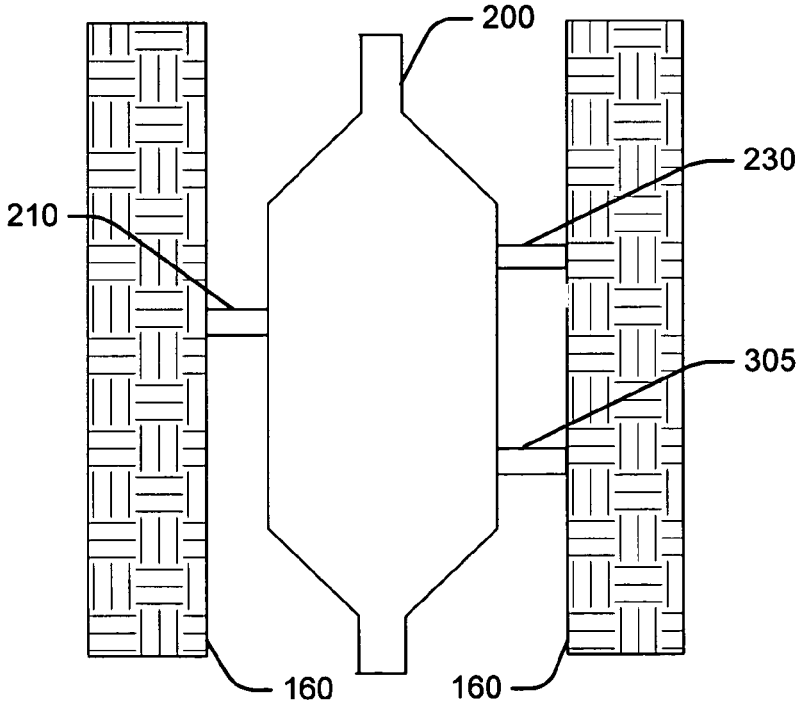
FIG. 4 shows a side view of a stabilized sampling system.

A side view of an MWD/LWD tool 200 in borehole 160 is shown in FIG. 4. As shown here, the sampling arm 210 and stabilizers 230 and 305 may be in different planes relative to each other, to increase the stability of the MWD/LWD tool 200 or to increase the range of formation that may be sampled, sensed, or tested by the sampling arm 210 and the stabilizers 230 and 305.

Returning to FIG. 2, both the sampling arm and the stabilizers, such as stabilizer 230, may be connected with one or more sensors such as sensors 240 and 245. The sensors 230 and 245 may measure one or more relevant properties and produce one or more signals indicative of the measured property. For example, each of sensors, such as sensors 240 and 245, may measure one or more of the following properties: formation pressure, formation resistivity, horizontal permeability, vertical permeability, rock strength, rock compressibility, direction of permeability, or resistivity. The sensors may also perform imaging such as acoustic or resistivity imaging or any other form of imaging. The sensor signals may be relayed to the local control unit 200 and to the surface control unit 185. The operation of the sensors 240 and 245 may be directed by the local control unit 201 or the surface control unit 185. The sampling arm 210 and the stabilizer 230 may each have an inner annulus to permit the sensors 240 and 245 to sample within the sampling arm 210 or the stabilizer 230 after they are engaged with the well bore 160.

The sampling arm 210, stabilizer 230, and sensors 240 and 245 may be positioned or oriented to facilitate directional measurements. For example, the sampling arm 210 and sensor 240 may be positioned and oriented by propulsion device 215 to determine one or more of the horizontal permeability of the formation, the vertical permeability of the formation, or the direction of permeability within the formation.

After the sampling arm 210 is forced against the formation, the system may reduce or increase the pressure within the sampling arm. In one example system, the pressure in the sampling arm 210 is reduced to reservoir pressure or reduced below reservoir pressure. To accomplish this, the sampling system includes a valve 250 and a pump 255 to reduce the pressure within the sampling arm 210. The sampling system may also include a fluid sampling unit, such as 245, to collect one or more fluid samples pumped from of the formation. The fluid sampling unit 245 may include additional functionality to identify or characterize the sampled fluid as drilling fluids (e.g., mud), formation fluid, or some mixture of drilling and formation fluids. The fluid sampling unit 245 may discard or remove drilling fluids from the formation sample, so that the samples in the fluid testing and sampling unit 260 are substantially formation fluid. The stabilizers, such as stabilizer 230, may also include a valve 265, a pump 270, and a fluid sampling unit 275.

One example MWD/LWD tool 200 may perform a draw down test on the formation. In the example system the sensor 240 may measure the pressure within the sampling arm 210. After the sampling arm 210 engages the borehole wall 160, the local control unit 200 may open the valve 250 and operate the pump 255 to lower the pressure within the sampling arm below the reservoir pressure. The local control unit 200 may then close the valve 250, deactivate the pump 255, and measure the pressure rise within the sampling arm 210. Based on the measured pressure increase versus time, the local control unit 200 or the surface control unit 185, may determine one or more physical properties of the formation, including, for example, permeability.

Figure 5:
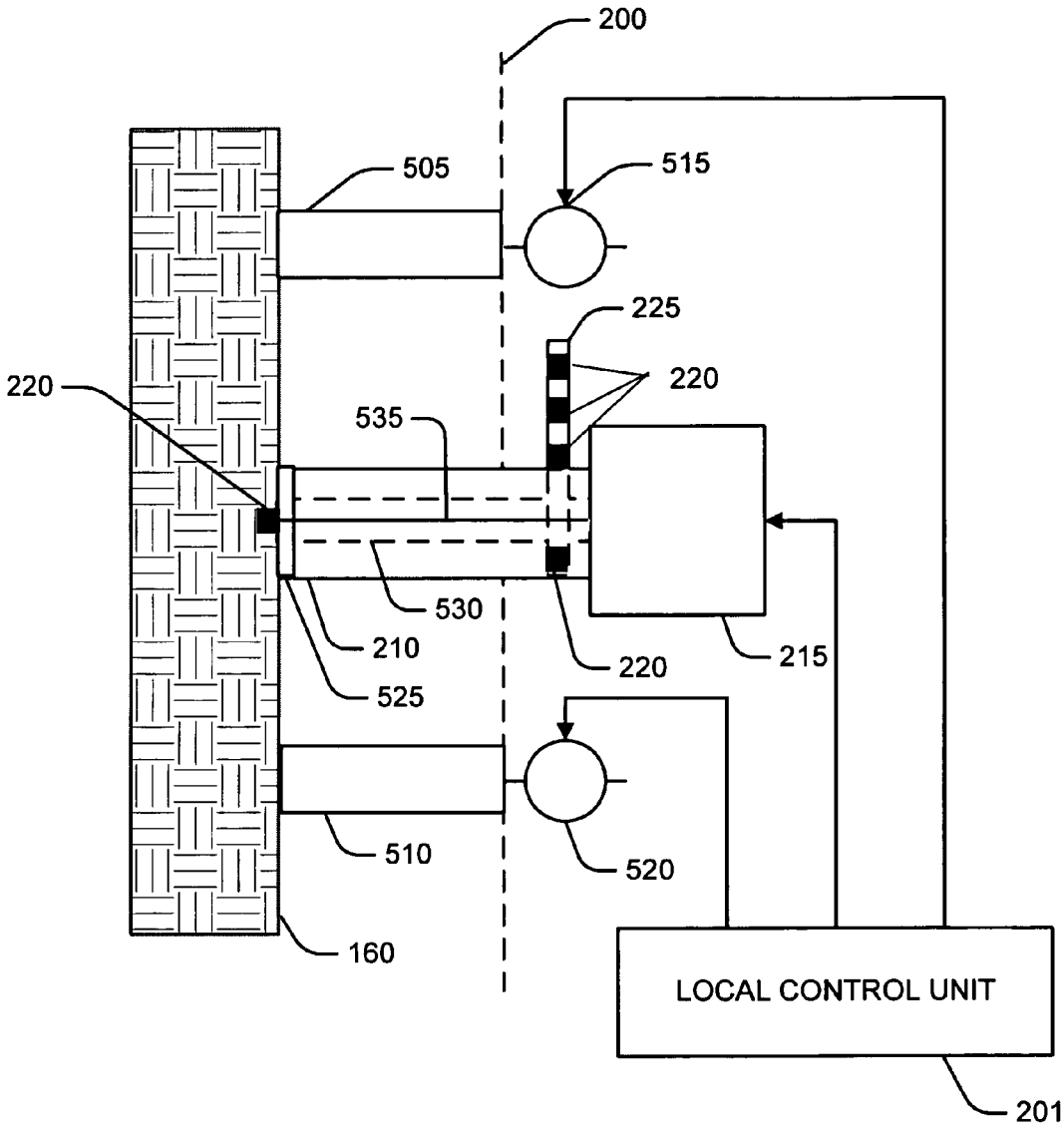
FIG. 5 shows a block diagram of a sampling system.

An example system for collecting a formation sample is illustrated in FIG. 5. In certain embodiments, the formation sample may also be referred to as a core or a core sample. The system may inflate or more inflatable packers, such as inflatable packers 505 and 510 around the portion of the borehole wall to be sampled. These packers may keep mud from flowing into the region of the borehole wall that is being sampled. The inflatable packers 505 and 510 may be inflated by one or more pumps, such as pumps 515 and 520. The pumps 515 and 520 communicate with the local control unit 200 and may be directed to pump fluid into or out of the packers 505 and 510, as necessary. The fluid to fill the packers may come from within the MWD/LWD tool 200, from the surface, or from the mud around the MWD/LWD tool 200, or the inner annulus 205 of the conduit 140.

In addition to the one or more inflatable packers, such as 505 and 510, the sampling system may use one or more pads to isolate the portion of the borehole wall being sampled. For example, the end of the sampling arm 210 may be fitted with a pad 525 to isolate and seal-off the portion of the borehole wall being sampled. The pad 525 may have a hole allowing samplers 220 to enter the formation.

The sampling arm 210 may include an inner annulus 530 allowing the formation sampler 220 to pass though the sampling arm 210 and into the formation. The sampler may be propelled by a drive arm 535 powered by the propulsion system 215. The propulsion system 215 may use the same drive used to extend the sampling arm 210, or it may use a separate drive system. In one example system, the propulsion system may use a drilling action, turning the formation sampler 220 while applying pressure, to force the formation sampler 220 into the formation. In another example system, the propulsion system may use a percussive system to force the formation sampler 220 into the formation. For example, the propulsion system 215 may detonate a charge behind the formation sampler 220, causing it to move into the formation.

In another example, the propulsion system 215 may use a repetitive percussive system to repeatedly apply pressure to the formation sampler 220 to force it into the formation.

The sampling system may take measurement while forcing the formation sampler 220 into the formation. In one example system where the sampler is drilled into the formation, the system measures the torque applied to the formation sampler 220 while it is being forced into the formation. This measurement may be relayed to the local control unit 200 or the surface control unit 185. The system may use such measurements to determine properties of the formation, such a bulk density, specific gravity, or rock strength of the formation. These measurements may be used to optimize the drilling operation.

The propulsion system 215 may also include functionality to retrieve the formation sampler 220 after sampling, or in case of a sampling failure. In one example system, the propulsion system may place the formation sampler 220 back in a slot in the carousel 225. In another example system, the propulsion system may force the formation sample out of the formation sampler 220 and into another container. The container may be a separate container for each formation sample, or it may be a container for multiple formation samples. In another example system, the propulsion system may include functionality to cap and uncap a formation sampler 220, using, for example, a sampler cap.

The system may perform testing while the formation sampler 220 is lodged in the formation. For example, the system may perform a draw down test, as described above. In such a test, fluids may be drawn through the formation sample, or the formation sample within the formation sampler 220. The system may be able to make a more accurate measurement of formation properties such a permeability in such a situation, because the dimensions of the formation within the formation sampler 220 are limited to the dimensions of the interior of the formation sampler 220. This testing may be performed where the formation sample contains original formation fluids. In one embodiment, the drawn down test or other formation tests may be performed after all or a portion of the formation sample has been removed from the formation, so that formation damage does not affect the formation test.

After retrieving a formation sampler 220 containing a formation sample, the system may perform local testing of the formation within the formation sampler 220. For example, the system may measure the resistivity, permeability, pressure drop across the formation sample, or any other property of the formation sample. This testing may be performed where the formation sample contains original formation fluids.

The formation and fluid samples may be returned to the surface for testing. The system may place the formation in a sealed container by, for example, capping the formation sampler 220. The container may also contain original formation fluids and may be at sampling pressure. The fluid samples may be sealed in separate containers. The system may then eject each of the sealed containers into the mud flow outside the MWD/LWD tool 200. The sealed container may then be retrieved in the mud return line 165, the mud pit, or another place. In another example system, the mud flow may be reversed and the sealed container may be place in the inner annulus 205 of the conduit 140. In such an example system, the sealed container may be retrieved by a catcher sub at the surface or in another portion of the mud system.

Based on measured properties of the formation sample, the operation of the drilling system may be modified. For example, the drill path may be altered based on the specific gravity, bulk density, or another measured property of the formation sample. The measured properties of the sample may also be used to determine interface areas or zones within the formation, and the drilling or other operations may be adjusted accordingly.

The propulsion device within the MWD/LWD tool 200, such as propulsion devices 215 and 235 may be driven locally, within the MWD tool, or they may be driven by the mud pumps or a hydraulic system, which in turn, may drive a downhole pump. Each of the propulsion devices 215 may be an electric motor or other drive system, a pneumatic drive system, a hydraulic drive system, or any other system to drive the system. In one example MWD/LWD tool 200, the propulsion device may be powered by the rotation of the conduit 140. If the propulsion devices are powered by the rotation of the conduit 140, the MWD/LWD tool 200 may be decoupled from the conduit 140, such that it will not rotate with the conduit 140.

Figure 6:
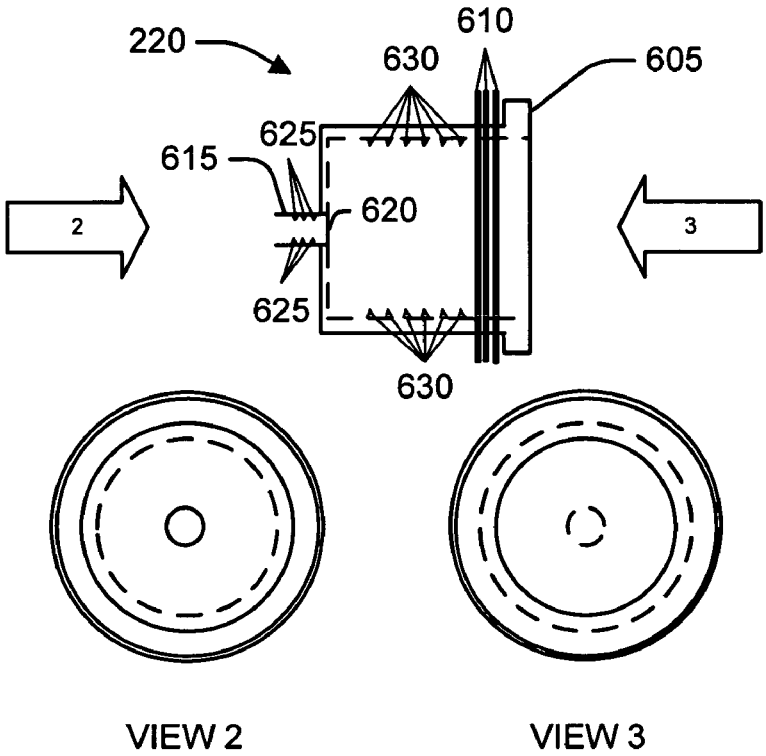
FIG. 6 illustrates a formation sampler in three views.

An example formation sampler 220 is illustrated in three views in FIG. 6. The formation sampler 220 has an interior and an exterior. The formation sampler 220 may include a cutting face 605 at the open end of the sampler. The cutting face 605 and the exterior of the sampler may include diamonds, a PDC type impression surface, or another arrangement to cut into the formation. The formation sampler 220 may include one or more oversized threads 610, which may allow closing and sealing the formation sampler 220. The oversized threading 610 may be slightly larger than the cutting face 605.

The closed end of the formation sampler 220, may include a valve 620 inside the formation sampler 220. The valve 620 may be a one way valve, a check valve, or another apparatus to permit fluid collection or sampling though the formation sampler 220. A coupler 615 may be attached to the exterior of the closed end of the formation sampler 220. One example coupler 615 may include threading 625 to mate with the drive arm 535. Another example coupler 615 may be shaped so that the drive arm can engage the exterior of the coupler 615. For example, the exterior of the coupler 615 may have a hex shape or external threading so that the drive arm 535 can couple with and drive the formation sampler 220.

The interior of the formation sampler 220 may also include threading 630 to engage and retain the formation within the sampler. The threading 630 may cut a grove into the formation. The threading 630 may then remain in the groove, which may cause the formation sample to break from the formation when the formation sampler 220 is withdrawn.

Figure 7:
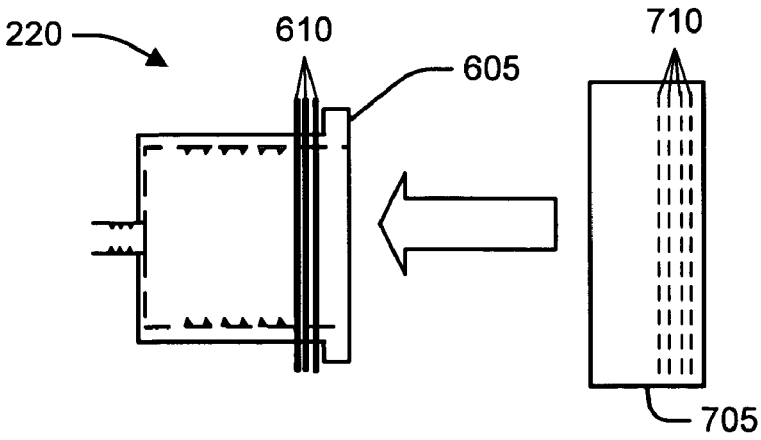
FIG. 7 illustrates a formation sampler and mating cap.

An example formation sampler 220 with core-cutter cap 705 is shown in FIG. 7. The core-cutter cap 705 may sealingly engage the formation sampler 220, using the oversized threads 610. The interior of the core-cutter cap 705 may include one or more threads 710 to engage the oversized threads 610. The capping or uncapping of the formation sampler 220 may be accomplished by the propulsion device 215, or by another device in the MWD/LWD tool 200. To inhibit moisture, the samplers 220 may be loaded into the sampler carousel 225 with core-cutter caps 705 attached. When the system is ready to use a formation sampler 220, it may remove the core-cutter cap 705 before sampling. The system may also place or replace a core-cutter cap 705 on the formation sampler 220 after sampling.

Figure 8:
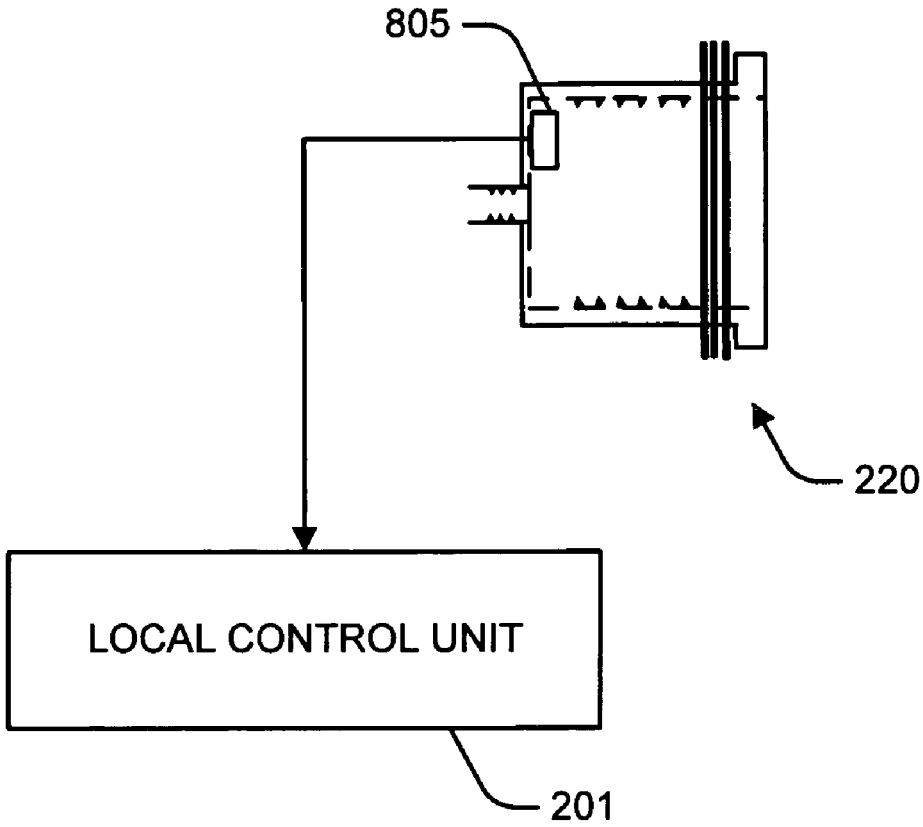
FIG. 8 shows a formation sampler with internal sensor.

Each of the samplers 220 may include a sensor, such as an internal sensor 805, shown in FIG. 8. The internal sensor 805 may measure a property of the formation while the formation sampler 220 is taking a sample, or after sampling, and produce a signal indicative of the measured property. The internal sensor 805 may relay the signal to the local control unit 200, which may, in turn, relay the signal to the surface control unit 185. Each of the internal sensors, such as sensors 805, may measure one or more of the following properties: formation pressure, formation resistivity, rock compressive strength, or torque to cut the formation. The sensors may also measure a fullness of the formation sampler 220. The sensor may measure a range of fullnesses of the sampler, or it may only sense when the sampler reaches one level of fullness. For example, the sensor 805 may include a switch that is closed when it comes into contact with the formation, indicating that the sampler has reached a level of fullness (e.g., completely full). In another example, the sensor may include an infinitely variable component (e.g., resistor, capacitor, or inductor) that can signal a level that the component is depressed (e.g., 1%, 50%, or 99%). Using the output of such a sensor 805, the local control unit 200 may monitor the progress of the sampler travel into the formation to determine a property of the formation (e.g., a density, a specific gravity, a bulk density, or a weight of the formation or formation sample). The output of the sensor 805 may also be used to determine when to stop driving the sampler into the formation or to diagnose problems with the sampling system. For example, the local control unit 200 may stop driving the sampler into the formation when the sampler reaches a desired level of fullness (e.g., completely full or 95% full). Each of the internal sensors, such as internal sensor 805, may also perform imaging such as sonic imaging or any other form of imaging. The internal sensors may also measure sampler torsion while sampling. The sampler torsion may be used to determine rock strength, which may, in turn, be used to prevent damage to the propulsion device or the propulsion device 215 or the formation sample within the formation sampler 220. The sampler torsion may also be used to determine if the sample within the formation sampler 220 is free from the formation.

Figure 9:
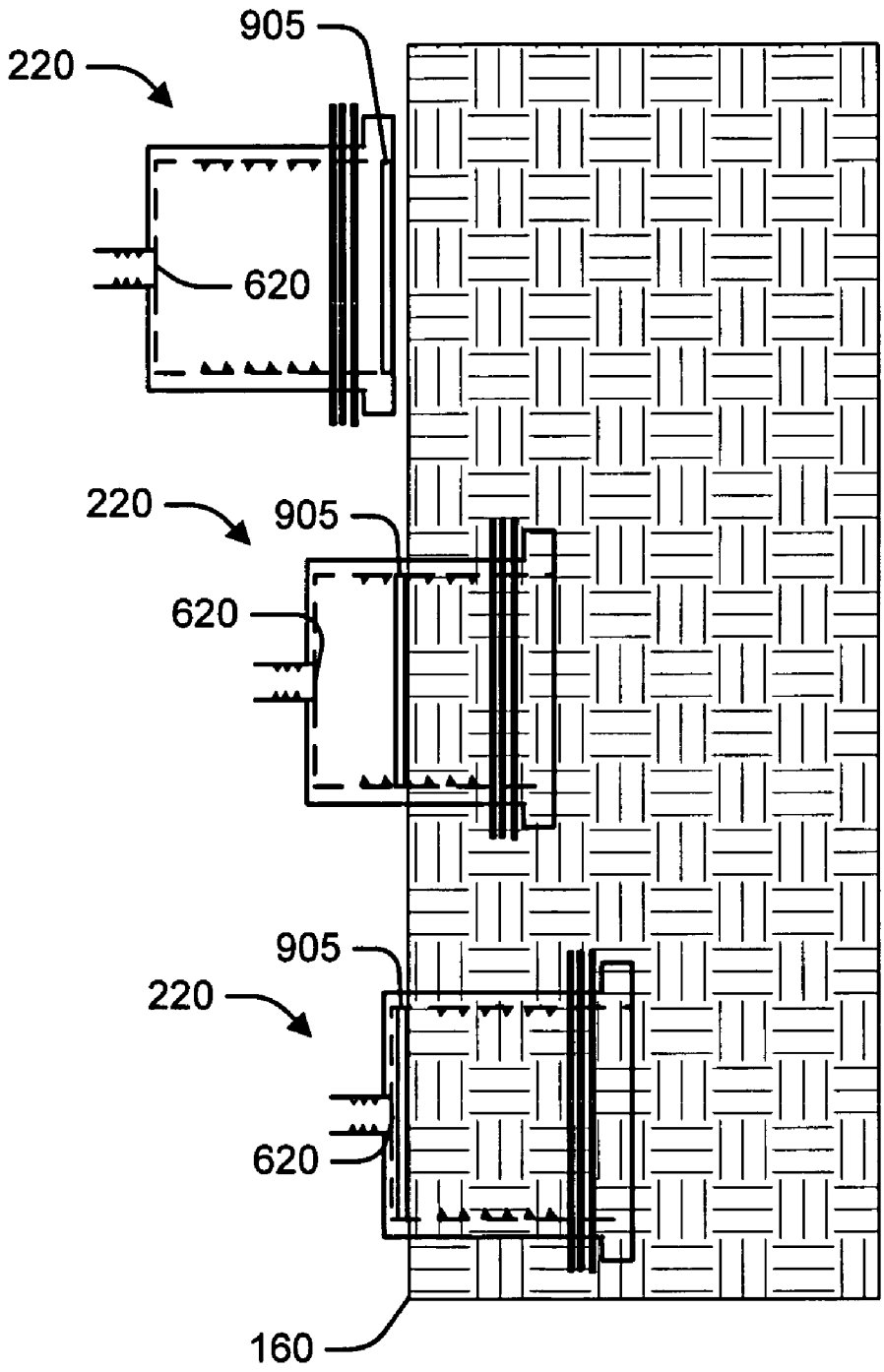
FIG. 9 shows a formation sampler entering a formation.

Another example formation sampler 220 entering a formation is illustrated in FIG. 9. The example formation sampler 220 include a flange piston 905 within the formation sampler 220. The example formation sampler 220 also includes a hydraulic o-ring 910. As the sampler enters the formation, the flange piston 905 is pressed into the formation sampler 220. Some of the fluids in the formation sampler 220 may be force though the hydraulic o-ring and out of the formation sampler 220. Such a formation sampler 220 can prevent moisture from leaking out of the formation sampler 220, which may better preserve the formation sample.

Figure 10:
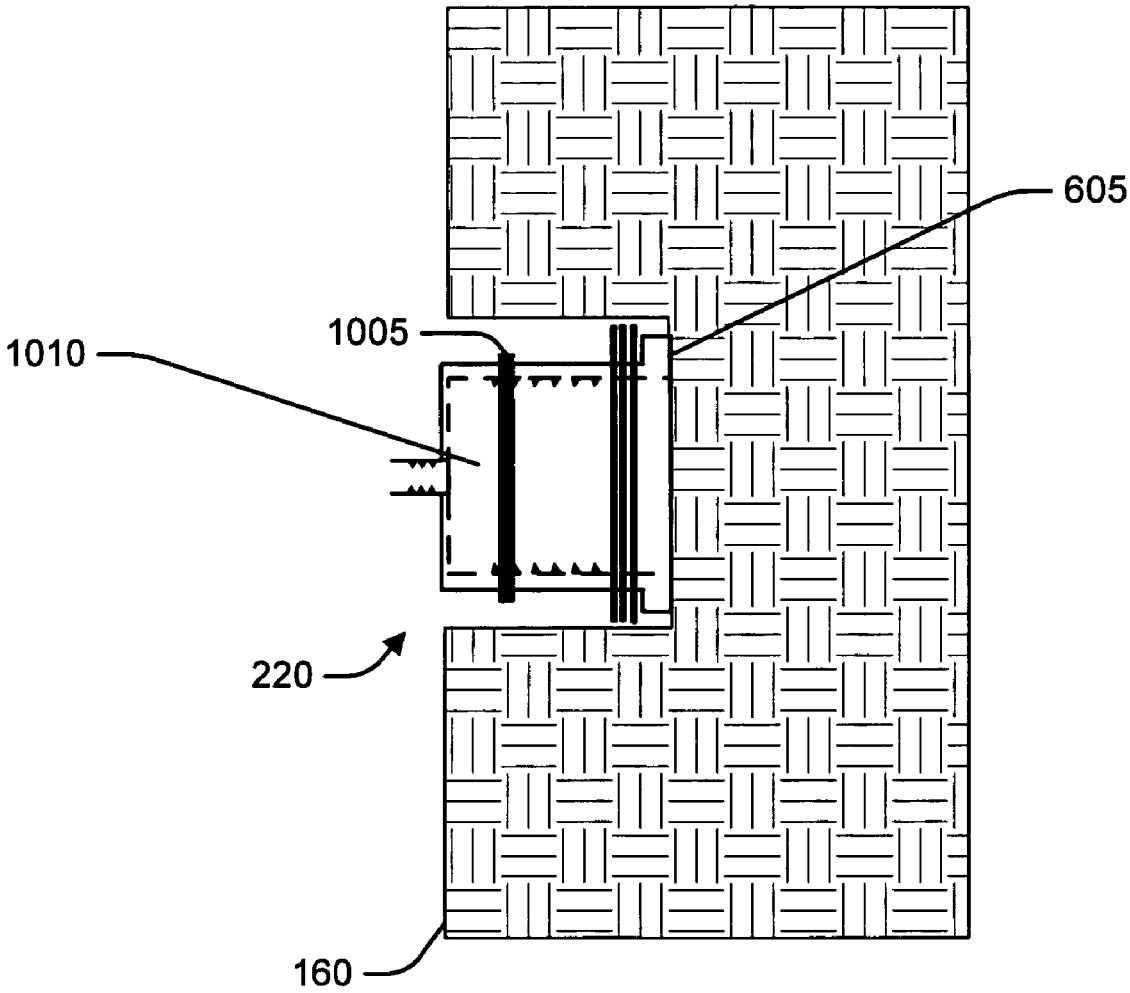
FIG. 10 illustrates a formation sampler with a squeeze ring.

Another example formation sampler 220 with a squeeze ring 1005 is shown in FIG. 10. The exterior of the formation sampler 220 may be threaded to accept the squeeze ring 1005, or the squeeze ring may be forced onto the formation sampler 220. The squeeze ring may apply inward pressure on the sampler, to help retain the sample within the formation sampler 220. The formation sampler 220 may also include other features to retain the sample. For example, the inner diameter of opening in the formation sampler 220 may be larger at the cutting face 605 than in the barrel 1010. In such an arrangement, the formation sample may be compressed as is forced into the barrel 1010.

Figure 11:
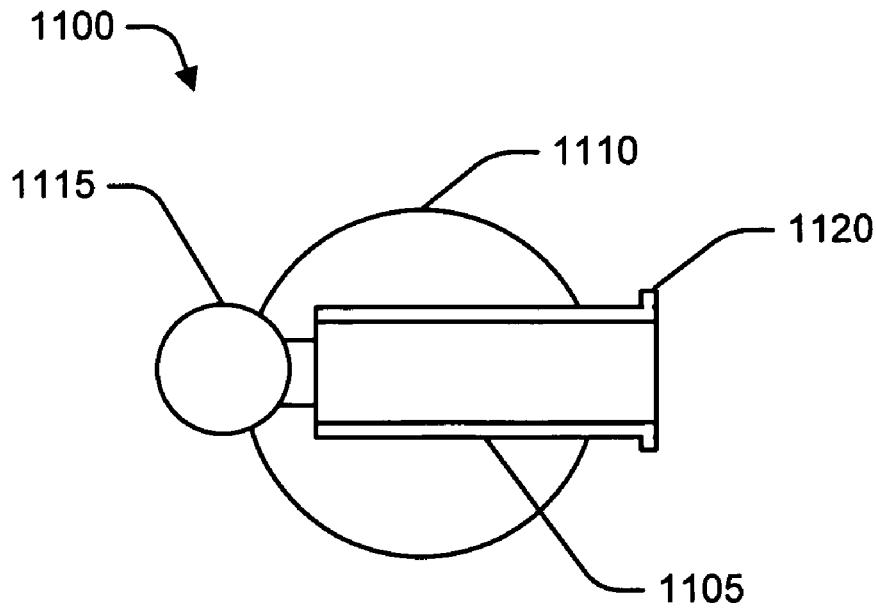
FIGS. 11-12 shows a cross-sectional diagram of a formation sampler.

FIG. 11 shows another example formation sampler, shown generally at 1100. The formation sampler 1100 includes a sampling tube 1105, a float 1110 about the sampling tube 1105, and a protective seal 1115. In certain implementations, the formation sampler 1100 may include one or more sensors, such as sensor 805 shown in FIG. 8. In some implementations, the formation sampler 1100 may include one or more data tags to stay in the formation sampler 1100, and one or more data tags 1100 to be placed in the formation at or about a sampling location. The sampling tube 1105 may be a thin-walled metal tube with a base 1120 to facilitate the removal of the formation sample 1100 from the formation. In one example embodiment the sampling tube may have a 0.25 inch diameter and may be ⅝ inch long. The cutting edge of the sampling tube 1105 may be beveled to facilitate entry into the formation.

The protective seal 1115 may displace drilling fluids or filter cake while the formation sampler 1100 is being forced into a formation. The protective seal may be flexible and compressible to be forced into the sampling tube 1105 once the formation sampler 1100 is driven into the formation. The protective seal 1115 may further prevent the loss of a formation sample once the formation sampler 1100 is removed from the formation. The protective seal may be secured to the formation sampler 110 by the float 1110 before the formation sampler 1100 is driven into the formation.

The float 1110 may be secured to the outer diameter of the sampling tube 1105 and may be made of a highly flexible material. In one example implementation, the float 1110 may be made from a urethane rubber. The float 1110 may further seal the sampling tube 1105, once the sampler 1100 is removed from the formation, as discussed with respect to FIGS. 12-14 below. The float 1110 may also increase the buoyancy of the formation sampler 1100 to allow it to return to the surface after sampling. In one example implementation, the formation sampler 1100 may have a neutral to slightly positive buoyancy relative to the drilling fluid in the borehole 160.

Figure 12:
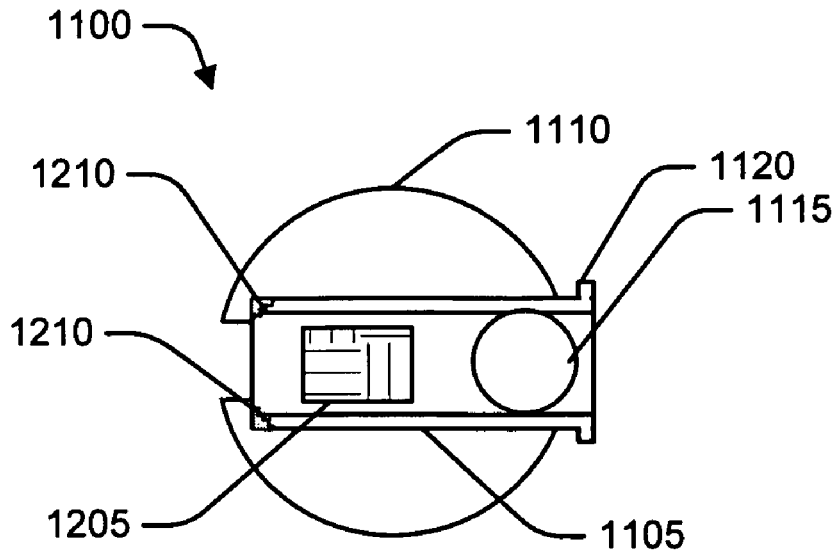
Figure 13:
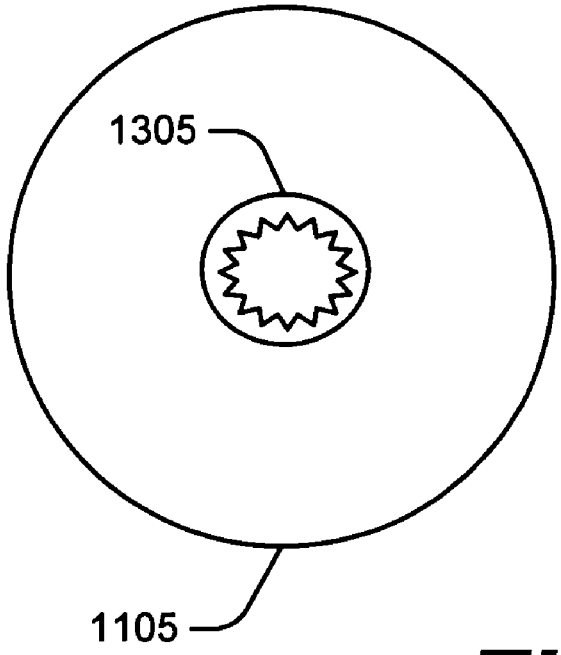
Figure 14:
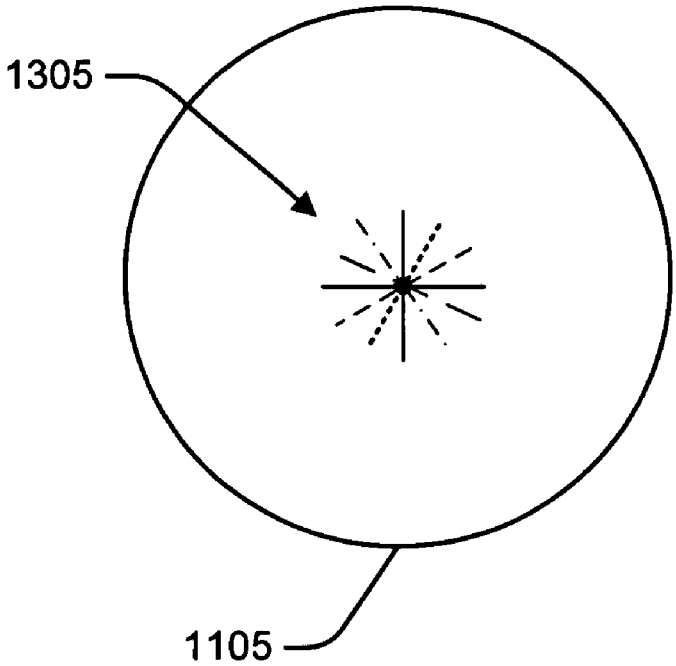

An example formation sampler 1100 with a formation sample 1205 is shown in FIG. 12. The formation sampler 1100 may form crimps 1210 to help retain the formation sample 1205. The float 1110 may further close around the open end of the sampling tube 1105 to help retain the formation sample 1205. An example of the face of the float 1110 while it is pressed against a formation is shown in FIG. 13. The float may have an opening 1305 to allow the formation sample 1205 to enter the sampling tube 1105. As shown in FIG. 14, however, the opening 1305 may close once the formation sampler 1100 is removed from the formation.

FIGS. 15A-15H demonstrate an example sampling procedure using the formation sampler 1100. In 15A the formation sampler 1100 is held by grips 1515. The grips 1515 may be part of the propulsion system 215 in one example implementation. A force block 1510 forces the formation sampler 1100 toward the formation.

Figures 15A, 15B, 15C, 15D:
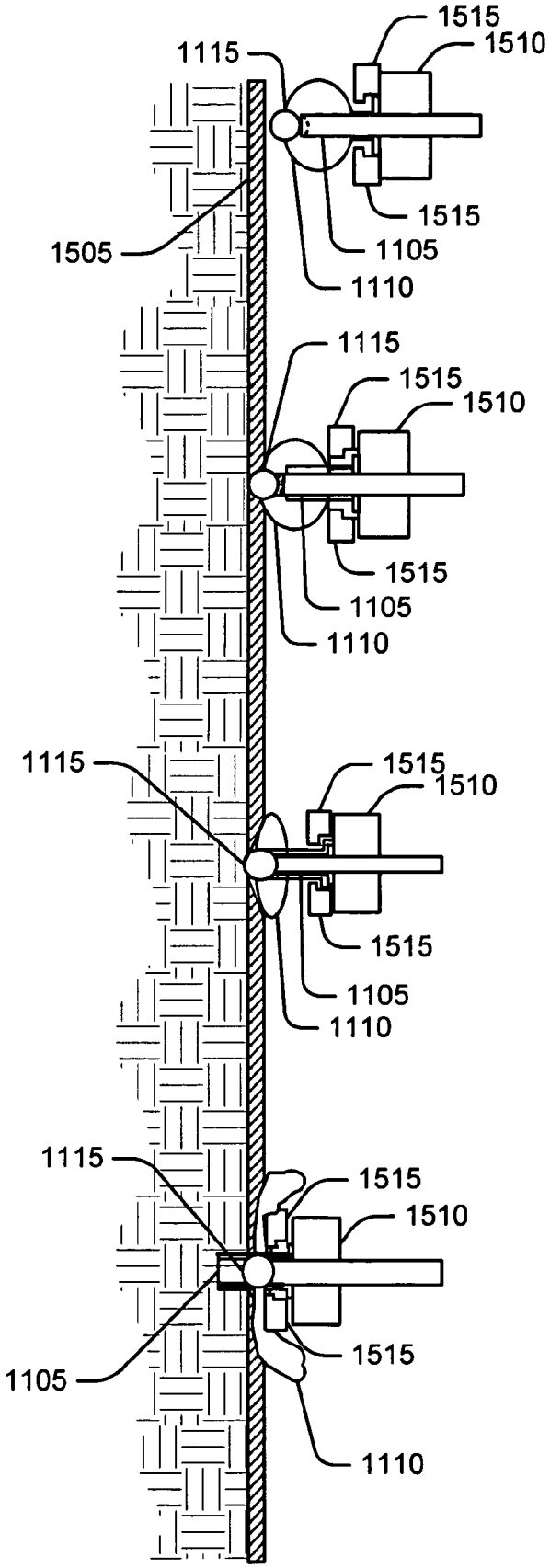
FIGS. 15A-15H are cross-sectional diagrams of a formation sampler in operation.

In FIG. 15B, the protective seal 1115 is in contact with a layer 1505 on the outside of the formation. The layer 1505 may include drilling fluid, filter cake, or other sediment or fluids. The protective seal 1115 may remove some or all of the layer 1505 at the sampling location.

In FIG. 15C, the protective seal 11 15 is forced into the sampling tube 1105. The float 1100 is forced against the formation and may deform. The float 1100 may remove further parts of the layer 1505 and may help to keep drilling fluid out of the sampling tube 1105 while the formation is being sampled.

Turning to FIG. 15D, the force block 1510 drives the formation sampler 1100 into the formation. In some example implementations the formation sampler 1100 is pushed, impact hammered, or twisted into the formation. In some example implementations, the sampling tube 1105 may include bumps to impart a wiggle to the sampling tube 1105 while it is driven into the formation.

Figures 15E, 15F, 15G, 15H:
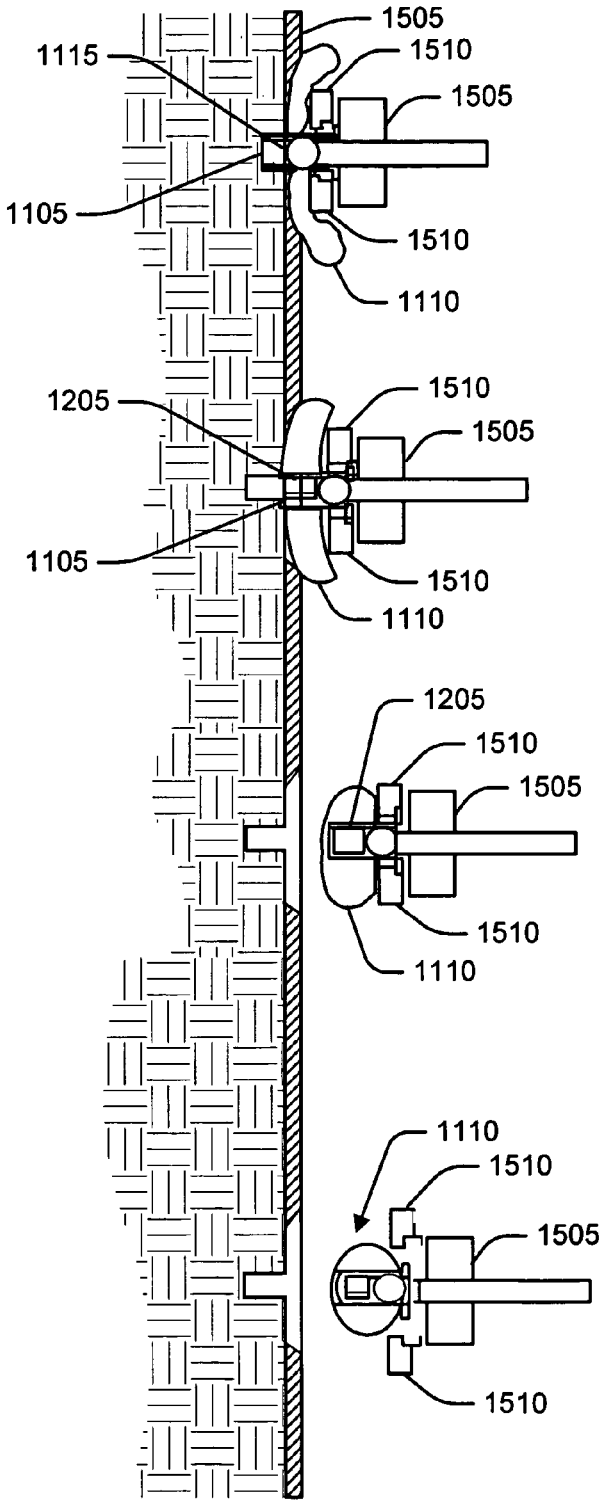

In FIG. 15E, the force block 1510 may impart one or more forces to break the formation sample free from the formation for extraction. In one example implementation the formation sampler 1100 may be given one or more sharp blows to break the formation sample 1205 free. In other implementations, a twisting motion or a wiggle may be imparted to the sampling tube 1105 to free the formation sample. These forces may also aid in formation the crimps 1210 in the formation sampling tube 1105.

Turning to FIG. 15F, the grips 1510 may tighten on the sampling tube 1105 to aid in extraction of the sampling tube 1105 from the formation. The drive block 1505 may begin imparting one or more forces to remove the formation sampler 1100 from the formation. These forces may include force away from the formation, twisting, or wiggling forces to remove the sampling tube 1105 from the formation. The removal process may be slow than the entering of the formation. The deformed float 1100 may provide additional force to aid in the removal of the sampling tube 1105 from the formation.

In FIG. 15G, the sampler 1100 is removed from the formation with the formation sample 1205. The float 1100 closes around the open end of the sampling tube 1105 to at least partially seal the sampling tube 1105. In FIG. 15H, the grips 1510 may be retracted from the formation sampler 1110, to allow the sampler to be returned to the surface, or for other operations, which are discussed below.

Figure 16:
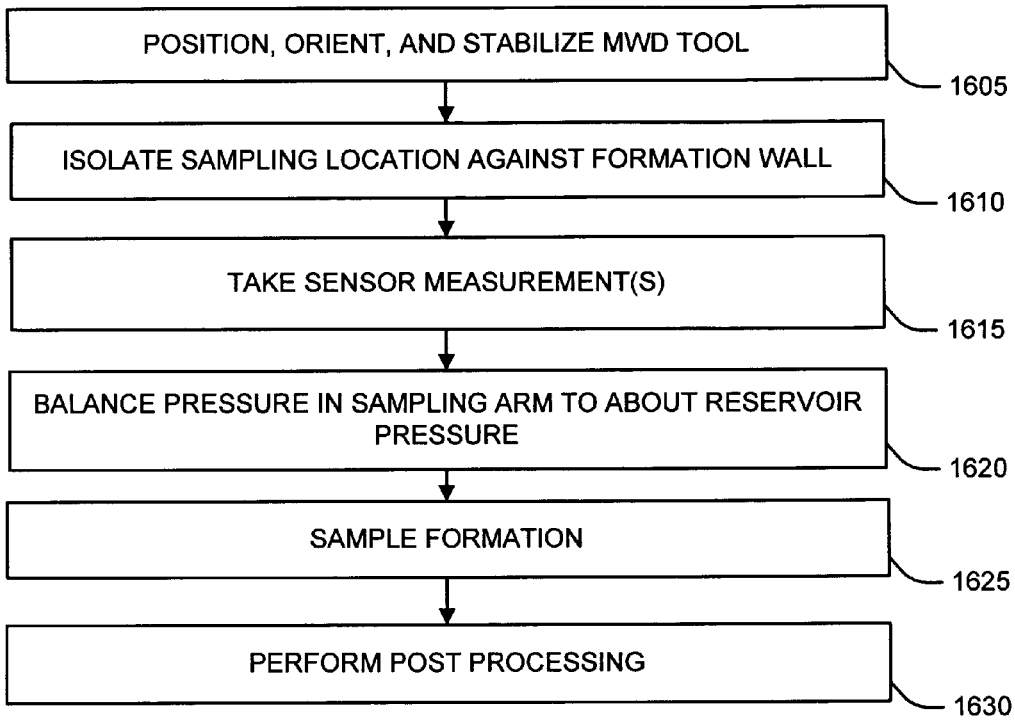
FIGS. 16-25 are block diagrams of downhole sampling systems.

A flow chart of an example system for sampling a formation is shown in FIG. 16. The system stabilizes, positions, and orients the MWD/LWD tool 200 (block 1605). Block 1605 is shown in greater detail in FIG. 12. The system may adjust the position (block 1705) and orientation (block 1710) of the MWD/LWD tool 200. The system may also adjust the position and orientation of components within the MWD/LWD tool 200, including the sampling arm 210 and one or more stabilizers, such as 230 and 305. The system may then stabilize the MWD/LWD tool 200 by extending one or more stabilizers such as stabilizers 230 and 305, as shown in FIGS. 3 and 4 (block 1715).

Returning to FIG. 16, the system may then isolates a sampling location against the borehole wall 160 (block 1610). Block 1610 is shown in greater detail in FIG. 13. The system may isolate the sampling site on the borehole wall 160 by inflating one or more inflatable packers, such as inflatable packers 505 and 510, shown in FIG. 5 (block 1805). The system may then extend the sampling arm 210 from the MWD/LWD tool 200, so that the sampling arm 210 sealingly engages with the borehole wall 160 (block 1810).

Returning to FIG. 16, the system then takes one or more sensor measurements (block 1615). Block 1615 is shown in greater detail in FIG. 14. The system may take one or more pressure measurements (block 1905). The system may measure the rate of fluid extraction (block 1910). While pumping or drawing down fluid the system may compare properties of the sampled fluid with petrophysical properties determined by temperature measurements, resistivity measurements, neutron sensor, formation density, sonic or infrared imaging, specific gravity measurements, viscosity measurement, or measured change in the resistance of fluid drawn though a formation sampler 220. The system may compare the measurements with surface or other downhole measurements. The system may measure the resistivity of the formation (block 1915). The system may also measure or analyze collected fluid properties (block 1915). The system may also perform draw down testing, as described above (block 1920). The system may further test for containments, such as heavy metals, $H_2S$, or $CO_2$.

The system may also draw fluid through the formation sample until the system determines that reservoir quality fluid has passed though the formation sample and then measure one or more of formation fluid and formation properties. Prior to extracting the formation sample for the formation sampler, fluid either carried downhole from the surface or fluid obtained downhole or fluid which has been drawn though the formation sample may be injected into the formation sample to measure mobility or pressure required to inject into the formation. In general, the system may control one or more of the rate, volume, and volume of fluid that is injected into the formation. Fluid being injected into the formation may be at or about formation temperature, higher than formation temperature, or below formation temperature.

Returning to FIG. 16, the system then reduces the pressure in the sampling arm 210 (block 1620). Block 1620 is shown in greater detail in FIG. 15. The system may draw the pressure in the sampling arm down below formation pressure by opening the valve 235 and operating the pump 240 to reduce the pressure in the sampling arm 210 (block 1505). The system may also take one or more fluid samples and store them in fluid sample container 245 (block 1510). In certain implementations, the fluid sample may be stored at or above the formation pressure in the fluid sample container 245. The system may also measure the sampled fluid's properties (block 1515). The system may also determine the composition of the sampled fluid (block 1520). In some example systems, the system may measure the fluid properties until it determines that the fluid sample is of reservoir quality and then store the fluid sample in the fluid sample container 245.

Returning to FIG. 16, the system then takes one or more formation samples (block 1625). Block 1625 is shown in greater detail in FIG. 16. The system may advance the sampler carousel 225, to obtain access to an unused formation sampler 220 (block 1605). If the formation sampler 220 is capped, the system may remove the sampler cap 705 and store it while sampling (block 1610). The system then forces the sampler into the formation (block 1615) and then retrieves the sampler from the formation (block 1620).

Figure 17:
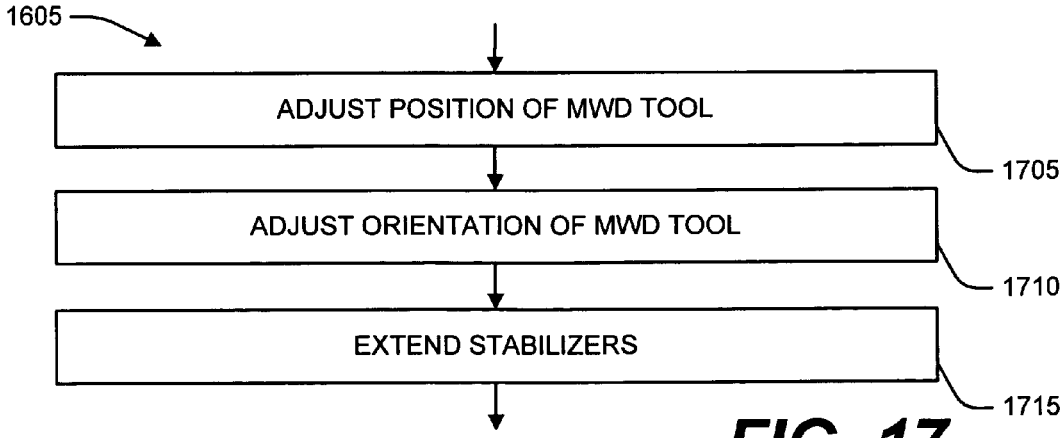
Figure 18:
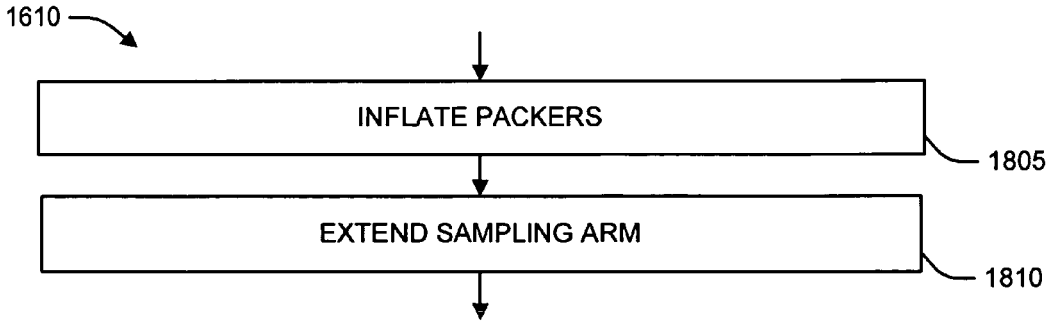
Figure 19:
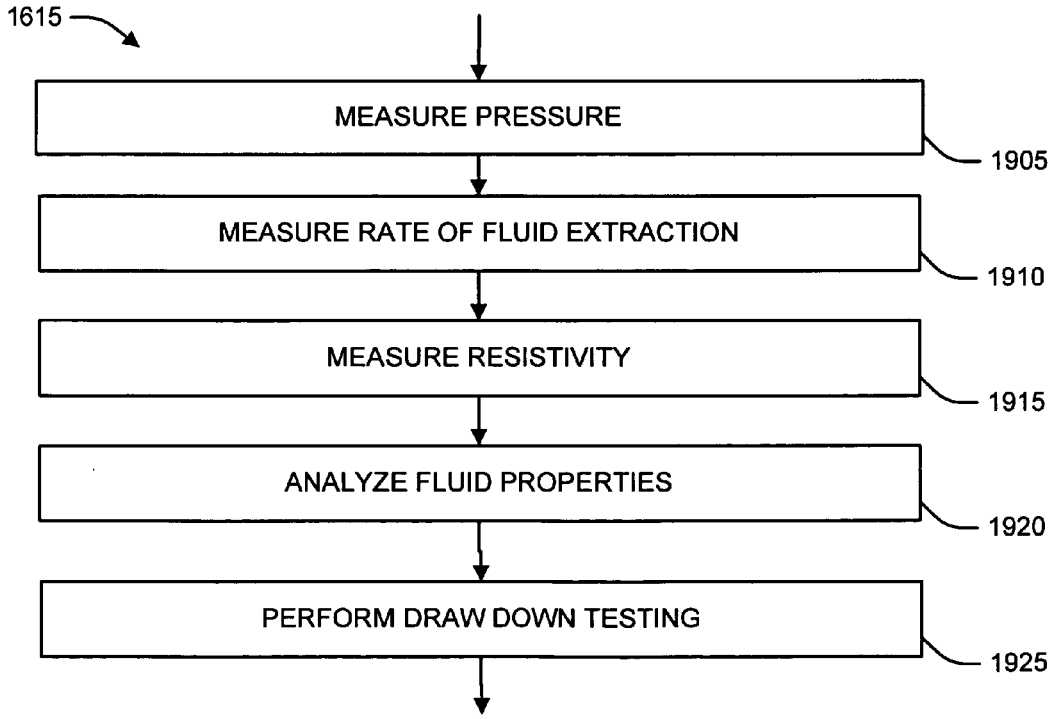
Figure 20:
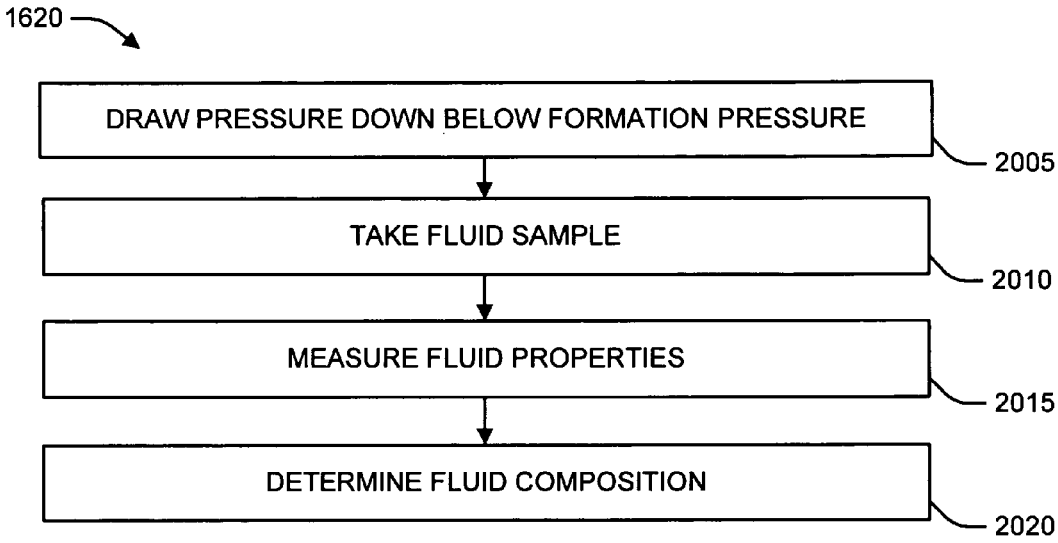
Figure 21:
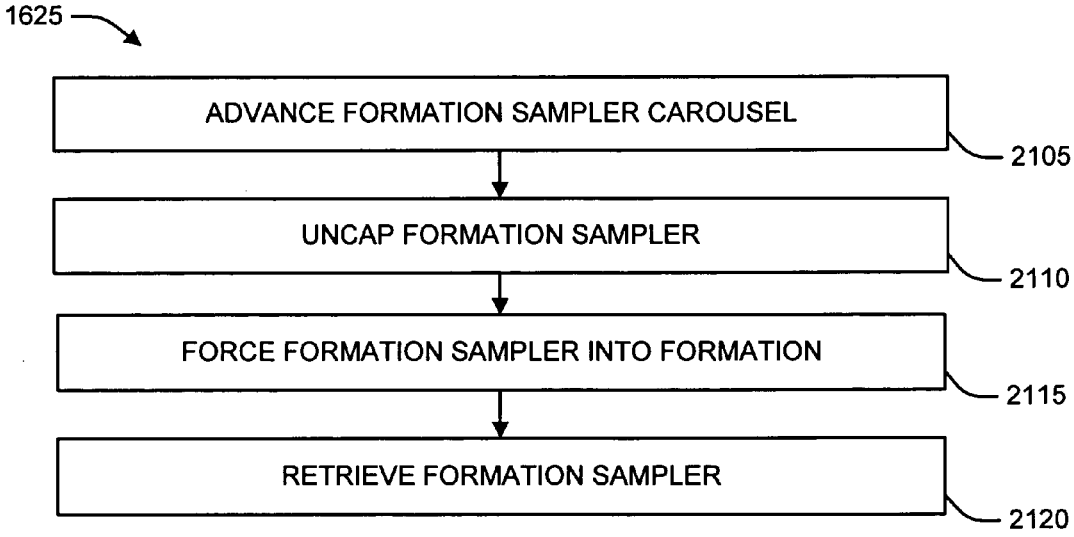
Figure 22:
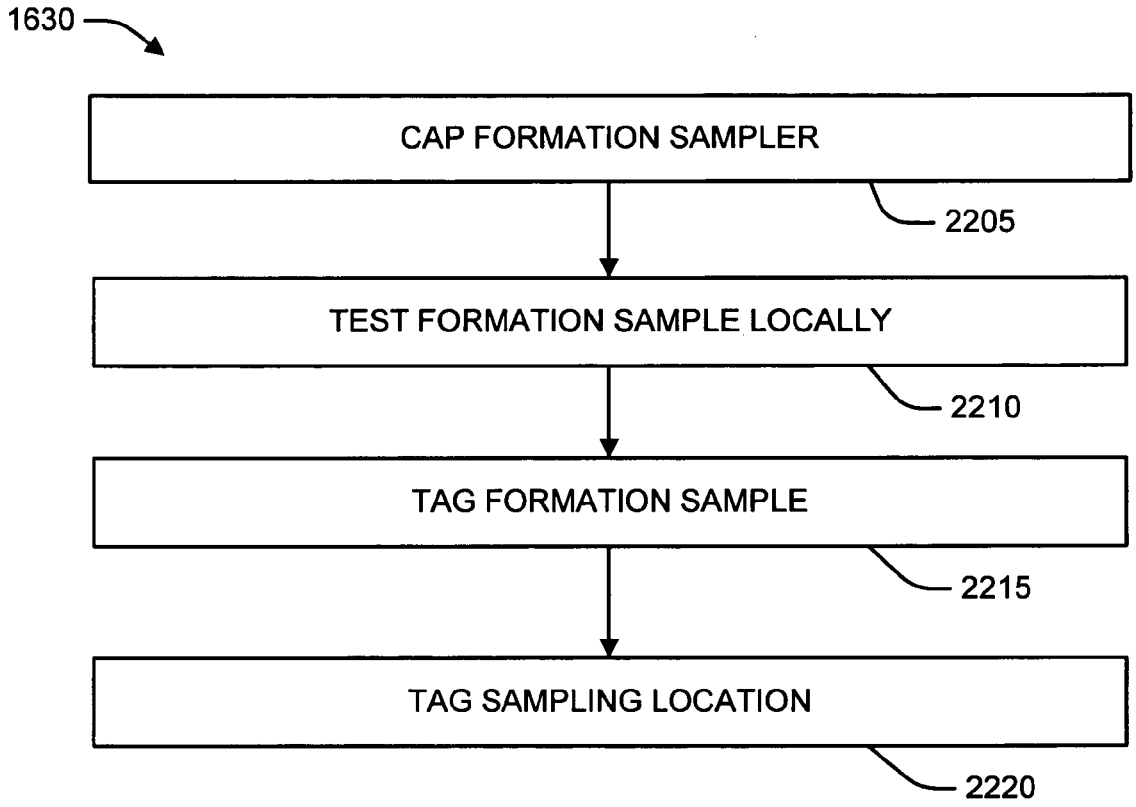

Returning to FIG. 16, the system may then perform post-processing functions (block 1630). Block 1630 is shown in greater detail in FIG. 17. The system may cap the formation sampler 220 with the sampler cap 705 (block 2205). The system may then test the formation sample locally (block 2210). In some implementations the system may tab one or more of the formation sample (2215) or the sampling location (block 2220). The formation sampler 220 or other portions of the MWD/LWD tool 200 may affix a data tag to one or more of the formation sample or the sampling location. In one example system, a Radio Frequency Identification (RFID) tag may be affixed to the formation sample or the sampling location. The data retrieval tag may include one or more pieces of information regarding the formation sample or the sampling location. For example, a serial number may be assigned to the pair of the formation sample and the sampling location so that the formation sample may later be associated with the sampling location. In other example system, the data tag attached to the formation sample may include information such as the depth at which the formation sample was retrieved. This data tagging may be used to calibrate other formation sampling or other downhole sensor measurements. In other example systems, the data retrieval tag attached to the sampling location may be readable after the borehole 160 is cased. The formation sampler 220 may also include functionality to mark the orientation of the formation sample in the formation sampler 220. This mark may be made during sampling or after sampling.

Figure 23:
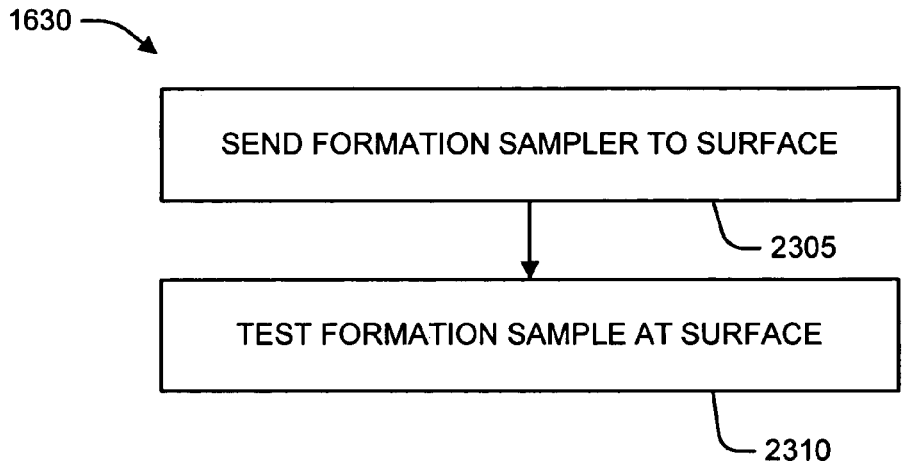
Figure 24:
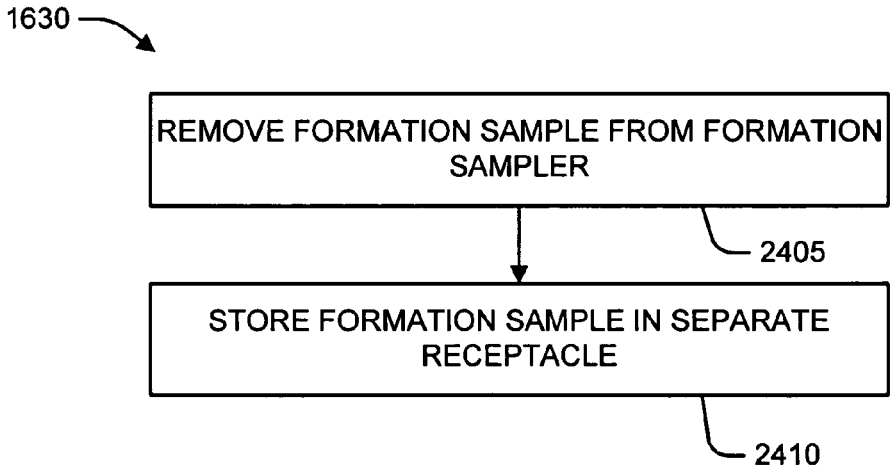
Figure 25:
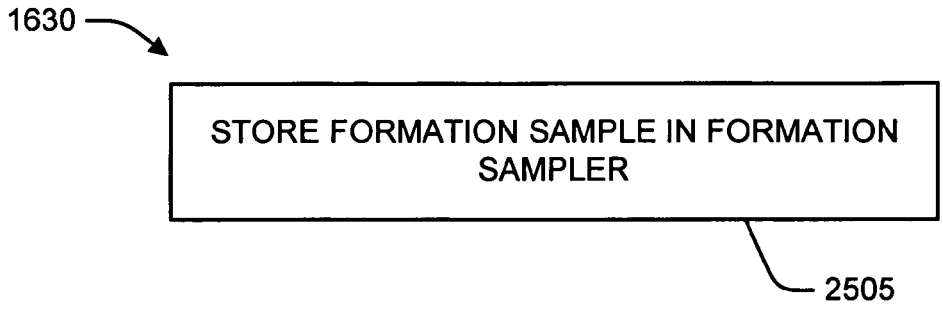

Further post processing functions (block 1630) are shown in FIGS. 23-25. In some example implementations, as shown in FIG. 23, the system may send the sealed formation sampler 220 to the surface (block 2305) for testing (block 2310). In other example systems, as shown in FIG. 23, the system may remove the formation sample from the formation -sampler 220 (block 2405) and store the formation in a separate receptacle (block 2410). In other example systems, as shown in FIG. 25, the system may store the formation in the formation sampler 220 (block 2505).

The present invention is therefore well-adapted to carry out the objects and attain the ends mentioned, as well as those that are inherent therein. While the invention has been depicted, described and is defined by references to examples of the invention, such a reference does not imply a limitation on the invention, and no such limitation is to be inferred. The invention is capable of considerable modification, alteration and equivalents in form and function, as will occur to those ordinarily skilled in the art having the benefit of this disclosure. The depicted and described examples are not exhaustive of the invention. Consequently, the invention is intended to be limited only by the spirit and scope of the appended claims, giving full cognizance to equivalents in all respects.

What is claimed is:

1. A formation sampling system, comprising:
a control unit;
at least one formation sampler to collect a formation sample;
a sampler carousel configured to store two or more formation samplers;
a sampler propulsion system to force a sampler into the formation, where the propulsion system is in communication with the control unit; and
a sampling system housing to engage a conduit, where the sampling system housing at least partially encloses the control unit, the at least one formation sampler, the sampler carousel, and the sampler propulsion system.

2. The formation sampling system of claim 1, further comprising:
one or more stabilizers to extend from the sampling system housing and engage the formation, where the stabilizers coupled to the control unit; and
a sampling arm to selectively engage the formation, where the sampling arm coupled to the control unit.

3. The downhole sampling system of claim 2, where the sampling arm comprises:
a pad to sealingly isolate a portion of a formation wall.

4. The downhole sampling system of claim 1, where the at least one formation sampler comprises a protective cap to displace one or more of mud and filter cake from a sampling location.

5. The downhole sampling system of claim 1, where the at least one formation sampler comprises:
a float to make the formation sampler buoyant in a drilling fluid.

6. The downhole sampling system of claim 1, where the at least one formation sampler comprises:
a closed end;
an open end; and
an oversized thread about the open end to engage a sampler cap.

7. The downhole sampling system of claim 1, where one or more samplers comprise:
one or more sensors adapted to produce a signal indicative of a property.

8. The downhole sampling system of claim 1, where one or more samplers comprise:
a data tag to identify one or more properties of a formation sample in the formation sampler.

9. The downhole sampling system of claim 1, where at least one of the stabilizers comprises a stabilizer annulus, the downhole sampling system further comprising:
at least one pump to decrease to formation pressure about a sampling location, where the pump is at least partially disposed within the sampling system housing, and where the pump is further coupled to the stabilizer annulus.

10. The downhole sampling system of claim 1, where the formation sampler comprises:
a piston and an o-ring to remove fluid from the formation sampler.

11. The downhole sampling system of claim 1, where the conduit includes one or more conduits selected from the group consisting of drillpipe, composite pipe, and coiled tubing.

12. The downhole sampling system of claim 1, further comprising:
at least one fluid sample reservoir to store a fluid sample.

13. The formation sampler of claim 12, further comprising:
a piston and an o-ring to remove fluid from the sampler.

14. The formation sampler of claim 12, further comprising:
a sampling tube to engage a formation and collect a formation sample; and
a protective seal to remove one or more of drilling fluid and filter cake from a sampling location.

15. The formation sampler of claim 14, where the protective seal is forced into the sampling tube when the formation sampler is forced into a formation.

16. The formation sampler of claim 14, further comprising:
a float disposed about the sampling tube to provide buoyancy to the formation sampler in a drilling fluid.

17. The formation sampler of claim 16, where the float is further to seal the formation sampler.

18. The formation sampler of claim 12, where the at least one formation sampler comprises:
a closed end;
an open end; and
an oversized thread about the open end to engage a sampler cap.

19. A method of sampling a formation, the method comprising:
disposing a downhole sampling system in a borehole, where the downhole sampling system is to engage a conduit;
extending at least one stabilizer from a downhole sampling system to engages the formation;
displacing drilling fluid or filter cake from a sampling location;
collecting a formation sample by forcing a formation sampler into the formation at a sampling location;
removing the sampler from the formation;
measuring one or more properties of the formation sample within the formation sample; and
sealing the formation sampler.

20. The method of claim 19, where sealing the formation sampler comprises:
engaging the formation sampler with a sampler cap.

21. The method of claim 19, further comprising:
extending a sampling arm from the downhole sampling system such that the sampling arm engages the formation, where the sampling arm includes first and second ends and a passage from the first end to the second end;
drawing down a pressure in the sampling arm; and
forcing a sampler through the sampling arm passage and into the formation.

22. The method of claim 19, further comprising:
sending the formation sample to the surface, without removing the downhole sampling system from a borehole.

23. The method of claim 22, further comprising:
reversing the mud flow about the downhole sampling system; and
ejecting the formation sample into an inner annulus of the conduit.

24. The method of claim 19, further comprising:
tagging the formation sample to permit later identification of the formation sample.

25. The method of claim 19, further comprising:
tagging the sampling location to permit later identification of the sampling location.

26. The method of claim 19, further comprising:
receiving a signal from a sensor in the formation sampler indicative of the fullness of the formation sampler.

27. The method of claim 19, further comprising:
collecting at least one fluid sample from the formation; and
measuring one or more fluid properties of the fluid sample.

28. The method of claim 27, further comprising:
determining whether the fluid sample is reservoir quality, and if so, storing the reservoir sample in a fluid sample chamber at or above reservoir pressure.

29. The method of claim 28, further comprising sending the formation sample to the surface, without removing the downhole sampling system from the borehole.

* * * * *